US006614154B2

(12) United States Patent
Shin et al.

(10) Patent No.: US 6,614,154 B2
(45) Date of Patent: Sep. 2, 2003

(54) TENSION MASK FRAME ASSEMBLY HAVING A VARIABLE AREA FOR DUMMY BRIDGES

(75) Inventors: Soon-cheol Shin, Suwon (KR); Sung-oh Rho, Seoul (KR); Chan-yong Kim, Incheon (KR); Jong-han Rhee, Suwon (KR)

(73) Assignee: Samsung SDI Co., Ltd., Suwon (KR)

( * ) Notice: Subject to any disclaimer, the term of this patent is extended or adjusted under 35 U.S.C. 154(b) by 159 days.

(21) Appl. No.: 09/838,582

(22) Filed: Apr. 20, 2001

(65) Prior Publication Data

US 2001/0052746 A1 Dec. 20, 2001

(30) Foreign Application Priority Data

Apr. 20, 2000 (KR) ..... 2000-20992
Apr. 20, 2000 (KR) ..... 2000-20993

(51) Int. Cl.[7] ..... H01J 29/07; H01J 29/81
(52) U.S. Cl. ..... 313/403; 313/407; 313/402
(58) Field of Search ..... 313/402, 403, 313/407, 269, 408; 445/47

(56) References Cited

U.S. PATENT DOCUMENTS 4,926,089 A 5/1990 Moore ..... 313/402
4,942,332 A 7/1990 Adler et al. ..... 313/403
6,437,496 B1 * 8/2002 Kim et al. ..... 313/402
6,472,806 B1 * 10/2002 Kim et al. ..... 313/403

FOREIGN PATENT DOCUMENTS

JP 2002150968 A * 5/2002 ..... H01J/29/07
JP 2002150969 A * 5/2002 ..... H01J/29/07

OTHER PUBLICATIONS

U.S. patent application Ser. No. 09/461,758, Wan et al., filed Dec. 16, 1999.
U.S. patent application Ser. No. 09/465,763, Wan et al., filed Dec. 17, 1999.

* cited by examiner

*Primary Examiner*—Nimeshkumar D. Patel
*Assistant Examiner*—Karabi Guharay
(74) *Attorney, Agent, or Firm*—Robert E. Bushnell, Esq.

(57) ABSTRACT

A tension mask frame assembly for a color picture tube includes a tension mask where a plurality of strips formed on a thin plate to be separated a predetermined distance forming slots, a plurality of tie bars for connecting the strips and sectioning the slots at a predetermined pitch, and a plurality of dummy bridges extending from at least one strip toward a facing strip in the slots sectioned by the tie bars, and a frame supporting the edge of the tension mask so that a not less than can be applied to the tension mask. In the tension mask frame assembly, the area of the dummy bridge of the tension mask is smaller from the central portion of the tension mask to the peripheral portion thereof.

38 Claims, 7 Drawing Sheets

TENSION MASK FRAME ASSEMBLY HAVING A VARIABLE AREA FOR DUMMY BRIDGES

CLAIM OF PRIORITY

This application makes reference to, incorporates the same herein, and claims all benefits accruing under 35 U.S.C. §119 from my two applications both entitled TENSION MASK FRAME ASSEMBLY OF COLOR PICTURE TUBE filed with the Korean Industrial Property Office on Apr. 20, 2000, and there duly assigned Ser. No. 20992/2000 and 20993/2000, respectively.

BACKGROUND OF THE INVENTION

1. Technical Field

The present invention relates to a color picture tube, and more particularly, to a tension mask frame assembly for a color picture tube in which the structure of a tension mask fixed to a frame is improved.

2. Related Art

In a color cathode ray tube (CRT) or color picture tube, an electron beam emitted from an electron gun passes through an electron beam passing hole of a tension mask and lands on a fluorescent film so that a fluorescent film is excited to form an image. A surface of a screen of a color picture tube where an image is formed is designed to have a predetermined curvature considering a trajectory of the electron beam emitted from the electron gun and deflected by a deflection yoke.

When the mask manufactured to have a curvature corresponding to the inner surface of the screen is heated by the electron beam emitted from the electron gun, that is, by thermions, a doming phenomenon in which the mask is bulged toward a panel occurs. The doming phenomenon prevents the electron beam from accurately landing on the fluorescent film. Also, since the screen surface is formed to have a predetermined curvature, a viewing angle is narrow and the fluorescent film is excited at the edge of the screen surface so that an image formed at the screen surface is deformed.

We have found that it can be difficult to design and manufacture an improved high quality tension mask frame assembly for color picture tube. Efforts have been made to improve color picture tube components.

Exemplars of recent efforts in the art include U.S. Pat. No. 4,926,089 for TIED SLIT FOIL SHADOW MASK WITH FALSE TIES issued to Moore, U.S. Pat. No. 4,942,332 for TIED SLIT MASK FOR COLOR CATHODE RAY TUBES issued to Adler et al., U.S. Ser. No. 09/461,758, now U.S. Pat. No. 6,472,806 and U.S. Ser. No. 09/465,763, now U.S. Pat. No. 6,437,496.

While these recent efforts provide advantages, I note that they fail to adequately provide a tension mask frame assembly for color picture tubes efficiently and conveniently reducing problems associated with the related art such as deformed images and dotted line smear problems.

SUMMARY OF THE INVENTION

To solve the above problems, it is an object of the present invention to provide a tension mask frame assembly of a color picture tube which can reduce generation of dotted line smear appearing on a screen of the tie bars and the dummy bridges due to a difference in the amount of light of an electron beam passing between the dummy bridges according to the incident angle of the electron beam.

Accordingly, to achieve the above object and others, there is provided a tension mask frame assembly for a color picture tube comprising a tension mask where a plurality of strips formed on a thin plate to be separated a predetermined distance forming slots, a plurality of tie bars for connecting the strips and sectioning the slots at a predetermined pitch, and a plurality of dummy bridges extending from at least one strip toward a facing strip in the slots sectioned by the tie bars, and a frame supporting the edge of the tension mask while tension is applied to the tension mask, in which the area of the dummy bridge of the tension mask gradually gets smaller from the central portion of the tension mask to the peripheral portion of the tension mask.

It is preferred in the present invention that the vertical length of each of the dummy bridges at the central portion of the tension mask is greater than the vertical length of each of the tie bars, and that the vertical length of each of the dummy bridges at the peripheral portion of the tension mask is the same as the vertical length of each of the tie bars.

To achieve the above object and others, there is provided a tension mask frame assembly for a color picture tube comprising a tension mask where a plurality of strips formed on a thin plate to be separated a predetermined distance forming slots, a plurality of tie bars for connecting the strips and sectioning the slots at a predetermined pitch, and a plurality of dummy bridges extending from at least one strip toward a facing strip in the slots sectioned by the tie bars, and a frame supporting the tension mask while tension is applied to the tension mask, in which the tension mask includes a uniform dummy bridge area portion in which the area of each of the dummy bridges is uniform in a direction toward the peripheral portion of the tension mask and a decreasing dummy bridge area portion in which the area of each of the dummy bridges gradually decreases from the uniform dummy bridge area portion to the peripheral portion of the tension mask.

It is preferred in the present invention that, given that the horizontal length of the tension mask is H, a boundary between the uniform dummy bridge area portion and the decreasing dummy bridge area portion is located at a position displaced by ±H/6 of the horizontal length of the tension mask from the central portion of the tension mask 60 in an X direction.

Also, it is preferred in the present invention that the vertical length of each of the dummy bridges disposed at the decreasing dummy bridge area portion gradually decreases as the dummy bridges are located closer to the peripheral portion of the tension mask, and that the area of each of the dummy bridges located at the outermost position of the peripheral portion of the tension mask is formed to be the same as the area of each of the tie bars.

To achieve the above object and others, there is provided a tension mask frame assembly for a color picture tube comprising a tension mask where a plurality of strips formed on a thin plate to be separated a predetermined distance forming slots, a plurality of tie bars for connecting the strips and sectioning the slots at a predetermined pitch, and a plurality of dummy bridges extending from at least one strip toward a facing strip in the slots sectioned by the tie bars, and a frame supporting the tension mask while tension is applied to the tension mask, in which the area of the dummy bridge at the central portion of the tension mask is greater than the area of the dummy bridge at the peripheral portion of the tension mask.

To achieve these and other objects in accordance with the principles of the present invention, as embodied and broadly described, the present invention provides a tension mask frame assembly apparatus for a color picture tube, the apparatus comprising: a tension mask forming a plurality of strips on a thin plate, a plurality of slots, a plurality of tie bars connecting said strips and sectioning said slots at a predetermined pitch, and a plurality of dummy bridges extending from at least one strip toward an adjacent strip in said slots, said strips being separated a predetermined distance by said slots, said tension mask having a central portion and having a plurality of edges; and a frame supporting said edges and applying tension to said tension mask, an area of each of said dummy bridges near said edges being less than an area of each of said dummy bridges at a central region of said tension mask.

To achieve these and other objects in accordance with the principles of the present invention, as embodied and broadly described, the present invention provides an apparatus, comprising: a tension mask including a plurality of strips formed on a thin plate and separated a predetermined distance by slots, a plurality of tie bars connecting said strips and sectioning said slots at a predetermined pitch, and a plurality of dummy bridges extending from at least one of said strips toward an adjacent one of said strips in said slots; and a frame supporting said tension mask and applying tension to said tension mask; said tension mask including a centrally-located uniform dummy bridge area portion in which the area of each of said dummy bridges is uniform, said tension mask including a decreasing dummy bridge area portion in which an area of each of said dummy bridges gradually decreases in a direction from said uniform dummy bridge area portion to a peripheral portion of said tension mask.

To achieve these and other objects in accordance with the principles of the present invention, as embodied and broadly described, the present invention provides a tension mask frame assembly apparatus for a color cathode ray tube, the apparatus comprising: a tension mask having a plurality of strips formed on a thin plate and separated a predetermined distance by slots, a plurality of tie bars connecting said strips and sectioning said slots at a predetermined pitch, and a plurality of dummy bridges extending from at least one of said strips toward an adjacent one of said strips in said slots sectioned by said tie bars; and a frame supporting said tension mask and applying tension to said tension mask, an area of one of said dummy bridges located at a central portion of said tension mask being greater than an area of one of said dummy bridges located at a peripheral portion of said tension mask away from said central portion.

The present invention is more specifically described in the following paragraphs by reference to the drawings attached only by way of example. Other advantages and features will become apparent from the following description and from the claims.

BRIEF DESCRIPTION OF THE DRAWINGS

In the accompanying drawings, which are incorporated in and constitute a part of this specification, embodiments of the invention are illustrated, which, together with a general description of the invention given above, and the detailed description given below, serve to exemplify the principles of this invention.

DETAILED DESCRIPTION OF THE INVENTION

Figure 1:
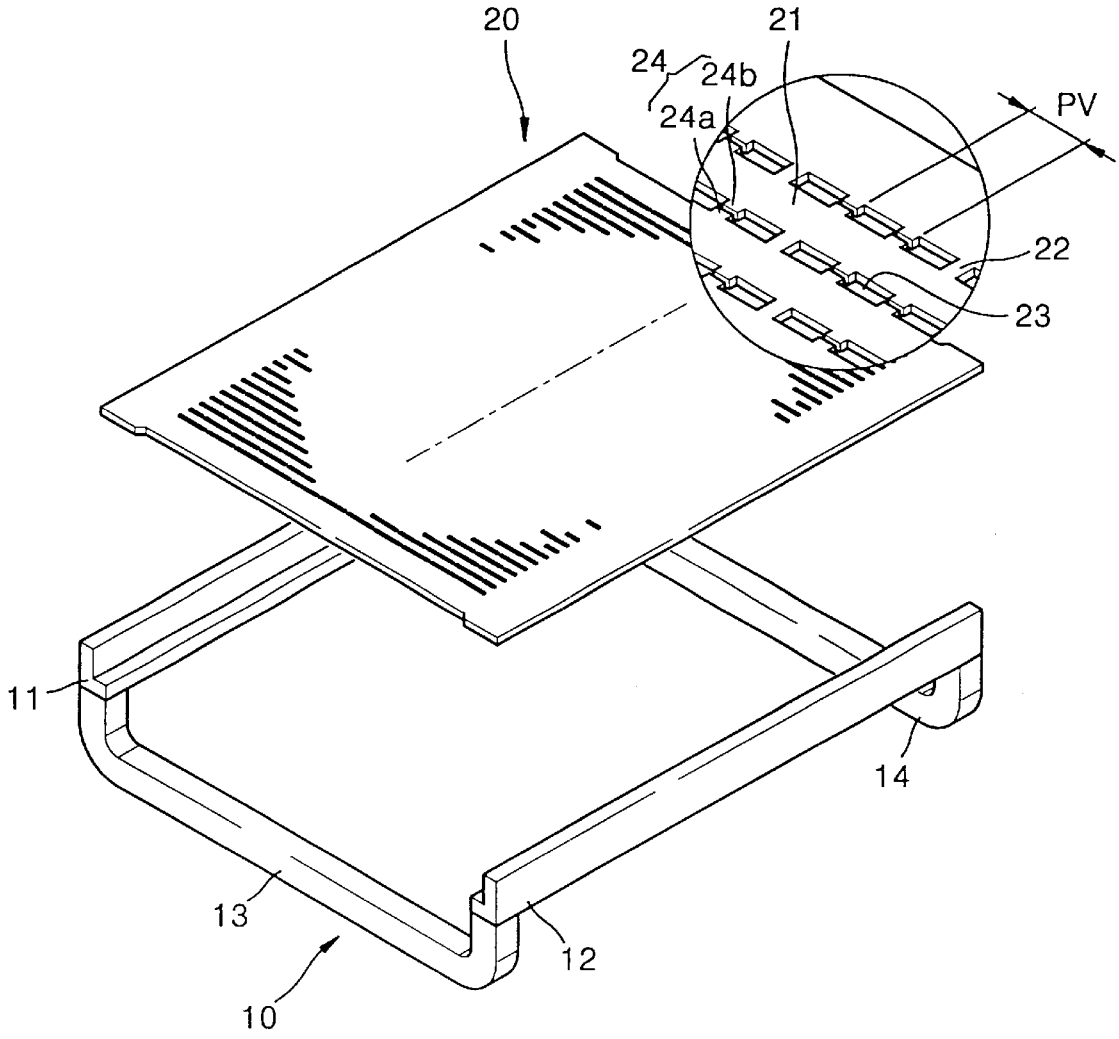
FIG. 1 is an exploded perspective view showing a tension mask frame assembly for a color picture tube.

While the present invention will be described more fully hereinafter with reference to the accompanying drawings, in which preferred embodiments of the present invention are shown, it is to be understood at the outset of the description which follows that persons of skill in the appropriate arts may modify the invention here described while still achieving the favorable results of this invention. Accordingly, the description which follows is to be understood as being a broad, teaching disclosure directed to persons of skill in the appropriate arts, and not as limiting upon the present invention.

Illustrative embodiments of the invention are described below. In the interest of clarity, not all features of an actual implementation are described. In the following description, well-known functions or constructions are not described in detail since they would obscure the invention in unnecessary detail. It will be appreciated that in the development of any actual embodiment numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill having the benefit of this disclosure.

As stated above, in a color picture tube, an electron beam emitted from an electron gun passes through an electron beam passing hole of a tension mask and lands on a fluorescent film so that a fluorescent film is excited to form an image. A surface of a screen of a color picture tube where an image is formed is designed to have a predetermined curvature considering a trajectory of the electron beam emitted from the electron gun and deflected by a deflection yoke. A doming phenomenon prevents the electron beam from accurately landing on the fluorescent film. Since the screen surface is formed to have a predetermined curvature, a viewing angle is narrow and the fluorescent film is excited at the edge of the screen surface so that an image formed at the screen surface is deformed.

To solve the above problem, a color picture tube having the outer circumferential surface of a panel which is formed to be flat has been developed. In the color picture tube, a tension mask is fixed to a panel to be separated a predetermined distance from a fluorescent film formed on the inner surface of the panel by being tensioned. The structure of the tension mask is disclosed in U.S. Pat. No. 4,926,089. In the tension mask, strips adjacent to a slot are connected by tie bars sectioning the slot. One or more false tie extending from the strips is formed at the sectioned slot. The pitch of the tie bar is variable.

Also, in a tied slit mask for color cathode ray tube disclosed in U.S. Pat. No. 4,942,332, tie bars are formed between slits which are formed by strips so that the strips are connected. The rate of change of pitch of the tie bars is random. False bars are installed at the edge of the slit between the tie bars at a uniform interval.

Refer now to FIG. 1, which is an exploded perspective view showing a tension mask frame assembly for a color picture tube. FIG. 1 shows an example of a slot type tension mask frame assembly which may be similar to concepts disclosed in U.S. patent applications corresponding to U.S. Ser. Nos. 09/461,758 and 09/465,763. As shown in FIG. 1, the slot type tension mask frame assembly consists of a frame 10 and a tension mask 20. The frame 10 has support members 11 and 12 installed parallel to each other, and elastic members 13 and 14 having elastic forces and connecting the support members 11 and 12. The long side portion of the tension mask 20 is welded at the support members 11 and 12 and the tension by the elastic members 13 and 14 is applied. A slot 23 is formed in a thin plate of the tension mask 20 by a plurality of strips 21 and tie bars 22 connecting the strips 21. A plurality of dummy bridges 24 formed by first and second protruding portions 24*a* and 24*b* extending toward the opposite strips are disposed at the slot 23 to section the slot 23 to have a predetermined vertical pitch PV.

In the tension mask frame assembly having the above structure which is installed to be separated from a fluorescent film formed on the inner surface of the panel of a cathode ray tube, an electron beam emitted from an electron gun passes through the slots 23 of the tension mask 20 and excites the fluorescent film to form an image. In this process, since the slot 23 is divided by the tie bars 22 and the dummy bridges 24, the tie bars 22 and the dummy bridges 24 prevent the electron beam from landing on an area of the fluorescent film corresponding to the tie bars 22 and the dummy bridges 24 so that the fluorescent film is not excited. Thus, shades of the tie bars 22 and the dummy bridges 24 appear on an image. Since the slots 23 are separated to have a uniform vertical pitch PV by the tie bars 22 and the dummy bridges 24, a dotted line smear problem can be improved.

However, since the dummy bridges 24 are formed by the first and second protruding portions 24*a* and 24*b* extending in the directions facing each other and do not contact each other, the electron beam passes between the first and second protruding portions 24*a* and 24*b* to excite the fluorescent film. Since the area of a shade appearing on the fluorescent film due to the tie bar 22 is different from that of a shade by the dummy bridge 24, dotted line smear appears on a screen. To solve the above dotted line smear problem, the dummy bridges 24 are formed to be greater than the tie bars 22.

Figure 2:
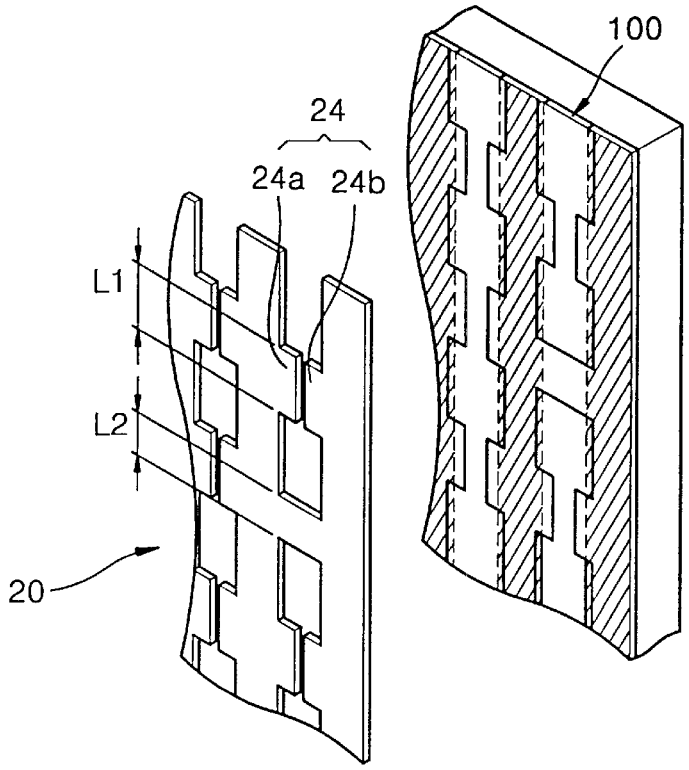
FIG. 2 is a view showing the state in which an electron beam passing through the tension mask lands on the central portion of the fluorescent film.
Figure 3:
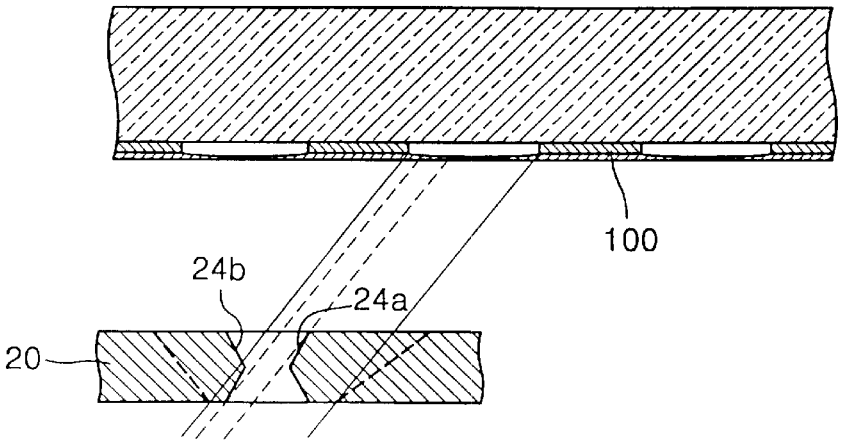
FIG. 3 is a view showing the state in which an electron beam scanning toward the peripheral portion of the fluorescent film is clipped.

Refer now to FIG. 2, which is a view showing the state in which an electron beam passing through the tension mask lands on the central portion of the fluorescent film. FIG. 2 shows a state in which an electron beam is scanned onto the central portion of the tension mask and the fluorescent film is excited. FIG. 3 shows a state in which an electron beam is scanned onto a peripheral portion of the tension mask and the fluorescent film is excited.

With continued reference to FIGS. 1 and 2, refer now to FIG. 3, which is a view showing the state in which an electron beam scanning toward the peripheral (edge) portion of the fluorescent film is clipped. As shown in FIGS. 1 and 2, since the vertical length L1 of each of the dummy bridges 24 is formed to be uniform at the central portion and the peripheral portion of the tension mask, a clipping phenomenon of an electron beam passing between the dummy bridges 24 located at the peripheral portion of the tension mask becomes severe.

That is, as shown FIG. 2, since the incident angle of the electron beam passing between the first and second protruding portions 24*a* and 24*b* of each of the dummy bridges 24 disposed at the central portion of a tension mask 20 decreases with respect to the tension mask 20, the amount of light of the electron beam is large so that part of a fluorescent film 100 is excited. However, as shown in FIG. 3, the incident angle of the electron beam passing between the first and second protruding portions 24*a* and 24*b* of each of the dummy bridges 24 disposed at the peripheral portion of the tension mask 20 increases with respect to the tension mask 20, the amount of light of the electron beam passing between the dummy bridges 24 is relatively smaller than that of the central portion. Accordingly, to improve visibility, when the vertical length L1 of each of the dummy bridges 24 is formed to be greater than the vertical length L2 of each of the tie bars 22 so that each dummy bridge is formed to have the substantially same area as that of each dummy bridge, a difference in the size of the shade between the tie bars 22 and the dummy bridges 24 is generated due to the difference in clipping of the electron beam passing between the dummy bridges 24 at the central portion and the peripheral portion. As a result, the brightness of the image in the entire area of an effective screen cannot be made uniform. Thus, resolution of an image cannot be improved.

Figure 4:
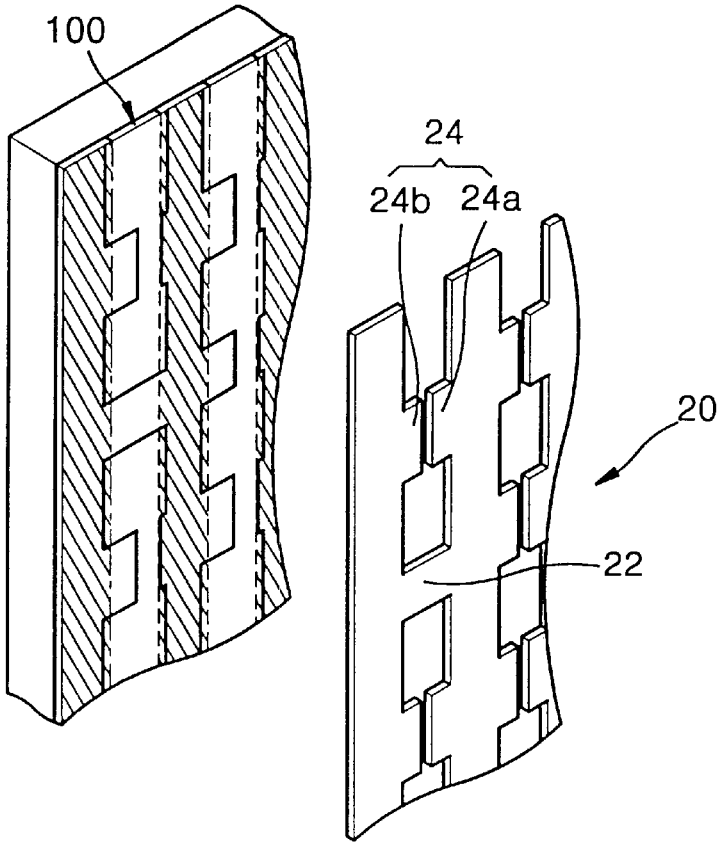
FIG. 4 is a view showing the state in which an electron beam passing through the tension mask lands on the peripheral portion of the fluorescent film.

Refer now to FIG. 4, which is a view showing the state in which an electron beam passing through the tension mask lands on the peripheral portion of the fluorescent film. FIG. 4 shows fluorescent film 100, tension mask 20, tie bar 22, and dummy bridge 24.

Figure 5:
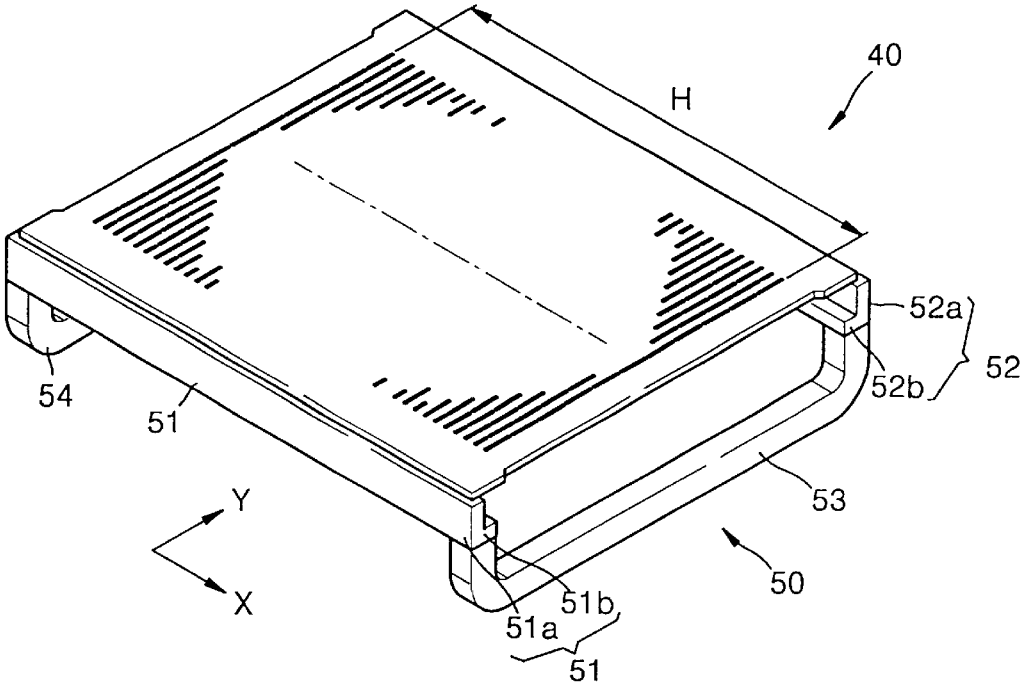
FIG. 5 is a perspective view showing a tension mask frame assembly of a color picture tube, in accordance with the principles of the present invention.

Refer now to FIG. 5, which is a perspective view showing a tension mask frame assembly of a color picture tube, in accordance with the principles of the present invention. Referring to FIG. 5, a tension mask frame assembly according to a preferred embodiment of the present invention includes a tension mask 40 having a color selection function of an electron beam and a frame 50 supporting the tension mask 40 while applying a predetermined tension force.

Figure 6:
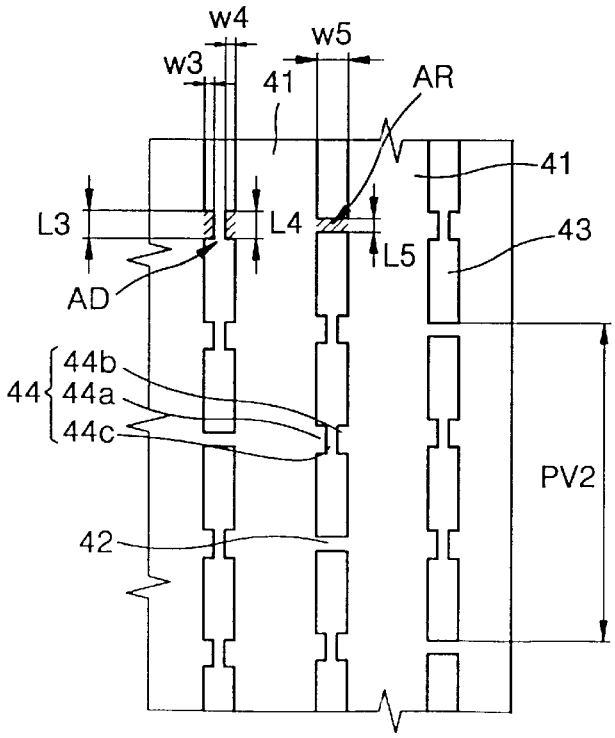
FIG. 6 is a partially cut-away plan view showing the tension mask of FIG. 5, in accordance with the principles of the present invention.

Refer now to FIG. 6, which is a partially cut-away plan view showing the tension mask of FIG. 5, in accordance with the principles of the present invention. In the tension mask 40, as shown in FIG. 6, a plurality of strips 41 are formed on a thin plate to be separated by a predetermined interval. The neighboring strips are connected by a real bridge 42 having a predetermined vertical pitch PV2, forming a plurality of slots 43. Dummy bridges 44 extending from one of the strips 41 formed on at least one side of the tension mask 40 are disposed at the slot 43 defined by the real bridge 42. The dummy bridge 44 is formed by first and second protruding portions 44*a* and 44*b* extending from the strips facing each other. Since the first and second protruding portions 44*a* and 44*b* do not contact each other, a dummy slot 44*c* is formed.

The area AD of the dummy bridge 44, that is, the areas of the first and second protruding portions 44*a* and 44*b*, is the sum of the results of multiplying the length of the first protruding portion by the width thereof and the length of the second protruding portion by the width thereof. Thus, AD=(L3×W3)+(L4×W4). The term L3 is the vertical length of the dummy bridge as shown in FIG. 6. The term L4 is the vertical length of the dummy bridge as shown in FIG. 6. The term L5 is the vertical length of the tie bar (real bridge) as shown in FIG. 6. The term W3 is the vertical width of the dummy bridge as shown in FIG. 6. The term W5 is the vertical width of the tie bar (real bridge) as shown in FIG. 6.

The area AR of the real bridge 42 is equal to the result of multiplying the length L5 of the real bridge 42 by the width W5 of the real bridge 42. To solve the dotted line smear problem, the area AD of the dummy bridge 44 is formed such that the difference between the area AD of the dummy bridge 44 and the area AR of the real bridge 42 is within ±30% with respect to the area AR of the real bridge 42. Thus, to solve the dotted line smear problem, the area AD of the dummy bridge 44 is formed so that the absolute value of the result of AD minus AR, when that absolute value is divided by AR, is less than or equal to 0.3. Thus, the area AD of the dummy bridge 44 is formed so that $(|AD-AR|)/AR \leqq 0.3$.

Preferably, the area AD of the first and second protruding portions 44*a* and 44*b* disposed at the central portion of the tension mask 40 is greater than the area AR of the real bridge 42 disposed at the central portion of the tension mask 40.

Also, the area of the dummy bridge at the central portion of the tension mask is formed to be greater than the area of the dummy bridge at the peripheral portion of the tension mask. The sum of the areas of the first and second protruding portions 44*a* and 44*b* gradually decreases from the central portion of the tension mask 40 to the peripheral portion thereof. Preferably, the sum of the areas of the first and second protruding portions 44*a* and 44*b* disposed at the peripheral portion of the tension mask 40 is equal to the area of the real bridge 42.

Figure 7:
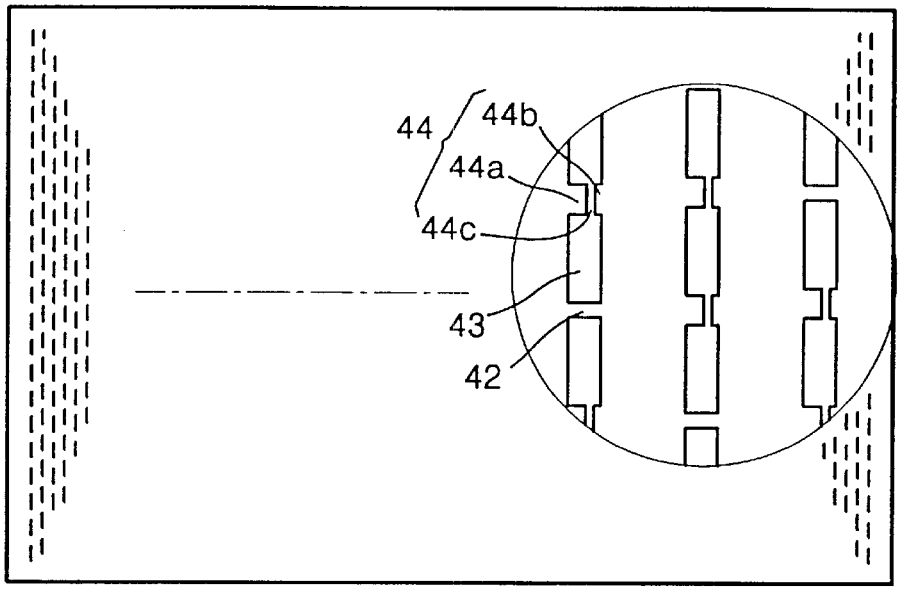
FIGS. 7 and 8 are plan views showing the shapes of real bridges of the tension mask, in accordance with the principles of the present invention.
Figure 8:
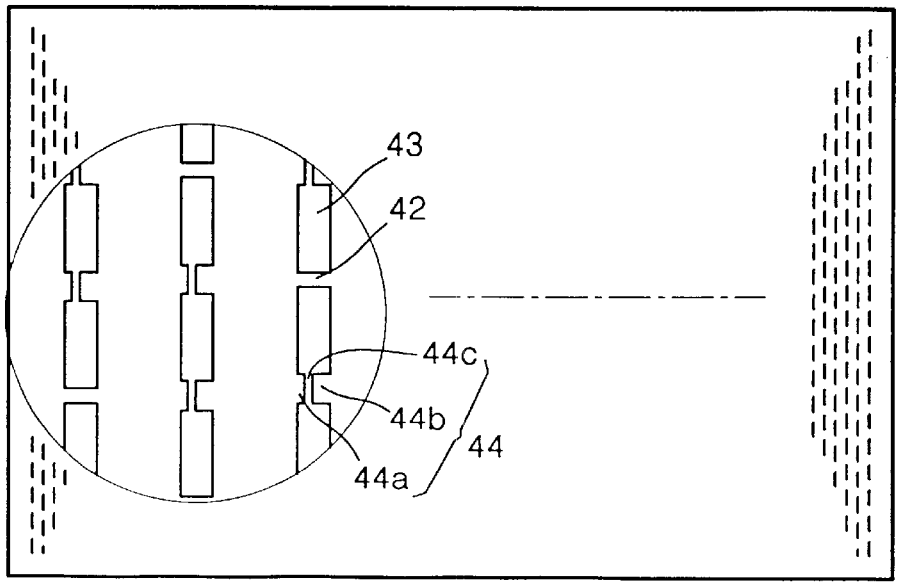

To make the areas of the first and second protruding portions constituting the dummy bridge 44 decrease toward the peripheral portion of the tension mask 40, the lengths L3 and L4 of the first and second protruding portions 44*a* and 44*b* are formed to gradually decrease from the central portion of the tension mask 40 to the peripheral portion thereof in a direction X Refer now to FIGS. 7 and 8, which are plan views showing the shapes of real bridges of the tension mask, in accordance with the principles of the present invention. Here, as shown in FIGS. 7 and 8, the position of the dummy slot 44*c* formed between the first and second protruding portions 44*a* and 44*b* is shifted (deviated) toward the peripheral portion of the tension mask 40 with respect to the center of the slot 43 formed by the strips 41 in the horizontal direction from the central portion of the tension mask 40 to the peripheral portion of the tension mask. The dummy slot 44*c* at the left and right sides with respect to the central portion of the tension mask 40 is formed such that the amount of displacement from the center of the slot 43 in the horizontal direction decreases considering the amount of light of the electron beam passing through the dummy slot 44*c* according to deflection of the electron beam from the peripheral portion of the tension mask 40 to the central portion thereof.

Figure 9:
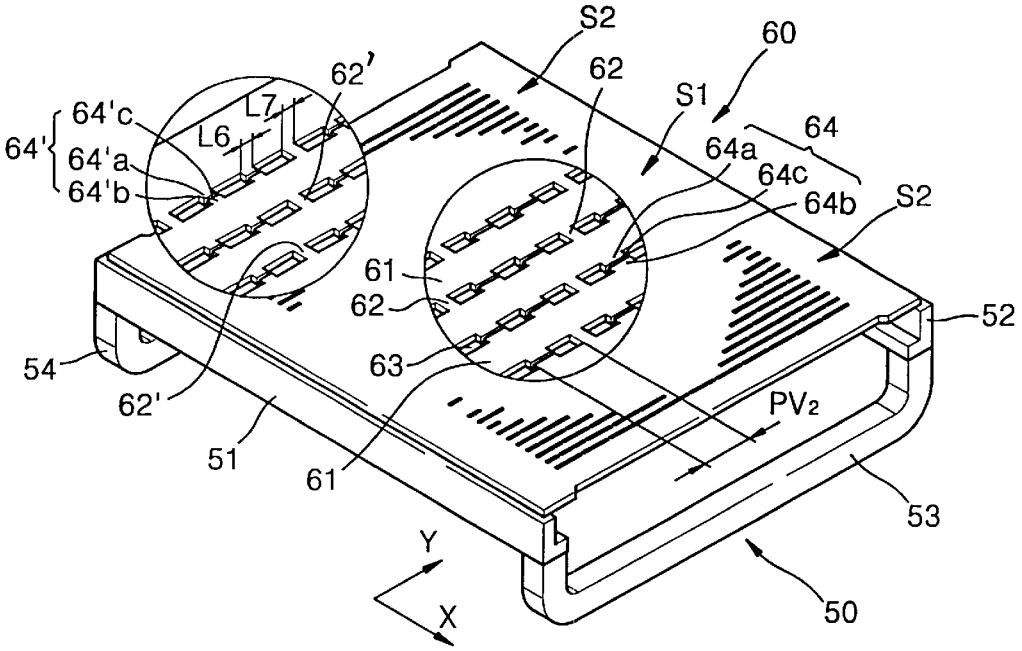
FIG. 9 is a perspective view showing a tension mask frame assembly according to another preferred embodiment, in accordance with the principles of the present invention.

Refer now to FIG. 9, which is a perspective view showing a tension mask frame assembly according to another preferred embodiment, in accordance with the principles of the present invention. Also, refer now to FIG. 10, which is a view showing a uniform area and a reduced area of a dummy bridge area of the tension mask, in accordance with the principles of the present invention.

Figure 10:
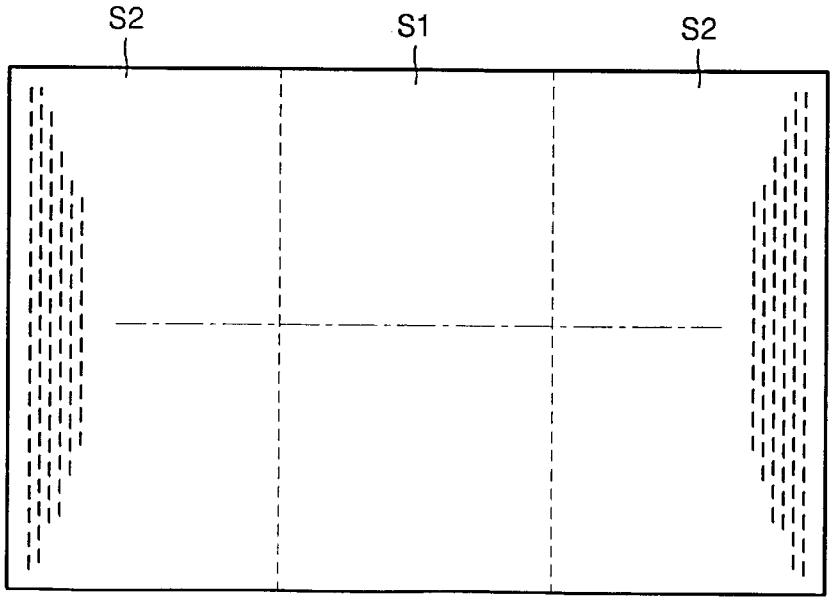
FIG. 10 is a view showing a uniform area and a reduced area of a dummy bridge area of the tension mask, in accordance with the principles of the present invention.

FIGS. 9 and 10 show a tension mask according to another preferred embodiment of the present invention. As shown in the drawings, a tension mask 60 has a plurality of slots 63 formed therein as the neighboring strips 61 connected by real bridges 62. Dummy bridges 64 consisting of first and second protruding portions 64*a* and 64*b*, each extending from the strips facing each other, and a dummy slot 64*c* formed between the first and second protruding portions 64*a* and 64*b*, are formed in the slots 63 sectioned by the real bridges 62.

The tension mask 60 is sectioned by a uniform dummy bridge area portion S1 in which the area of each of the dummy bridges 64 is larger than the area of the real bridge 62 which is uniform from the central portion of the tension mask 60 to the peripheral portion thereof in an X direction, and a decreasing dummy bridge area portion S2 in which the area of the dummy bridge 64' (the sum of the areas of first and second protruding portions 64*a*' and 64*b*') gradually decreases from the uniform dummy bridge area portion S1 to the peripheral portion.

Preferably, given that the horizontal length of tension mask is H, the boundary between the uniform dummy bridge area portion S1 and the decreasing dummy bridge area portion S2 is located at a position displaced by one sixth of the horizontal length H of the tension mask from the central portion of the tension mask 60 in the X direction.

Preferably, the sum of the areas of the first and second protruding portions 64*a*' and 64*b*' of a dummy bridge of the decreasing dummy bridge area portion S2 disposed at the outermost position at the peripheral portion of the tension mask 60 is equal to the area of the real bridge 62'. Also, the length L6 of the dummy bridge located at the outermost side is preferably formed to be equal to or greater than the length L7 of the real bridge 62'. To make the areas of the first and second protruding portions 64*a*' and 64*b*' forming the dummy bridge 64' decrease toward the peripheral portion of the tension mask 60, the vertical lengths of the first and second protruding portions 64*a*' and 64*b*' are formed to gradually decrease from the central portion of the tension mask 60 to the peripheral portion thereof in the X direction. Here, the position of the dummy slot 64*c*' formed between the first and second protruding portions 64*a*' and 64*b*' is shifted (deviated) toward the peripheral portion of the tension mask 60 with respect to the horizontal center of the slot 63 from the central portion of the tension mask 60 to the peripheral portion of the tension mask.

The frame 50 supporting the tension mask 60 includes support members 51 and 52 each supporting a long side portion of the tension mask 40 or 60, and elastic members 53 and 54 connecting the support members 51 and 52. The frame 50 is not limited to the above embodiment. A frame having a structure for supporting the tension mask to which tension is applied without reducing an effective screen when the frame is installed at the panel, may be adopted. The edge of the tension mask 40 in contact with support member 51 can be referred to as a support edge. The edge of the tension mask 40 in contact with support member 52 can be referred to as a support edge. The two edges of the tension mask 40 not in contact with support members 51 and 52 can be referred to as non-supported edges. All four edges of the tension mask 40 can be referred to as outermost edges. The frame 50 and elastic members 53 and 54 support and apply tension to the tension mask 40. The configuration of the frame 50 and elastic members 53 and 54 could be modified so that the tension mask 40 is supported at regions other than the edges.

Also, the tension mask 60 can be supported by the support members 51 and 52 shown in FIG. 9 in a manner where the support members 51 and 52 do not support the edges of the tension mask 60. In other words, the support members 51 and 52 can support the tension mask 60 at a region of the tension mask 60 other than the edge regions.

In addition, tension mask 60 can be supported by a support unit other than the support members 52 and 52 shown in FIG. 9. The principles of the present invention could be utilized with support members of varying sizes and configurations. The principles of the present invention could be utilized with a tension-causing unit that is not identical to the depicted arrangement of the elastic members 53 and 54 shown in FIG. 9.

Figure 11:
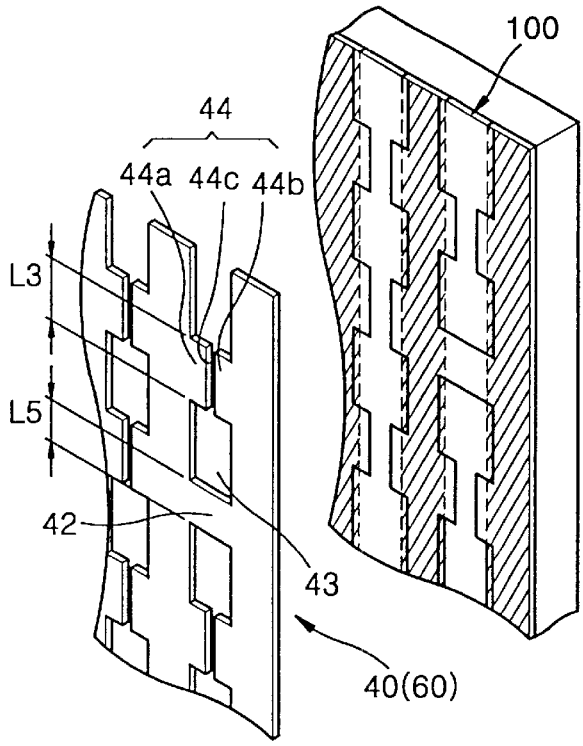
FIGS. 11 and 12 are views showing the state in which an electron beam passing through the tension mask lands on the fluorescent film, in accordance with the principles of the present invention.

Refer now to FIG. 11, which is a view showing the state in which an electron beam passing through the tension mask lands on the fluorescent film, in accordance with the principles of the present invention. Also, refer now to FIG. 12, which is a view showing the state in which an electron beam passing through the tension mask lands on the fluorescent film, in accordance with the principles of the present invention.

In the tension mask having the above structure, the difference in the area of the dummy bridge 44 dividing the slot 43 with respect to the area of the tie bar 42, that is, the area of the first and second protruding portions 44*a* and 44*b*, is formed within ±30% in the area of the central portion. The area of the dummy bridge 44 gradually decreases in relation to the area of the tie bar 42 from the central portion to the peripheral portion. In this way the dotted line smear problem, due to a difference in the shades of the tie bar and the dummy bridge appearing on an image formed as the fluorescent film is excited, can be improved.

In detail, the incident angle of the electron beam emitted from the electron gun of a picture tube increases from the central portion of the tension mask to the peripheral portion thereof. When the electron beam is scanned onto the central portion of the tension mask, as shown in FIG. 11, some of the electron beam passing through the slot 43 is completely shielded by the real bridge 42. However, since the dummy bridge 44 is formed to be large as much as the area of the dummy slot 44*c*, the shades of the real bridge 42 and the dummy bridge 44 appearing on the fluorescent film are the same so that the dotted line smear problem due to the shade can be solved.

When the electron beam emitted from the electron gun passes through the slot 43 disposed at the central portion of the tension mask 40, the incident angle on the slot 43 is small so that the amount of light of the electron beam passing through the dummy slot 44*c* is relatively small. Accordingly, the shade formed by the dummy bridge 44 is greater than the shade of the real bridge 42. However, since the vertical lengths of the first and second protruding portions 44*a* and 44*b* forming the dummy bridge 44 decrease from the central portion of the tension mask 40 to the peripheral portion thereof, the area of the dummy bridge 44 gradually decreases so that the shades of the real bridge 52 and the dummy bridge 54 become the same.

Figure 12:
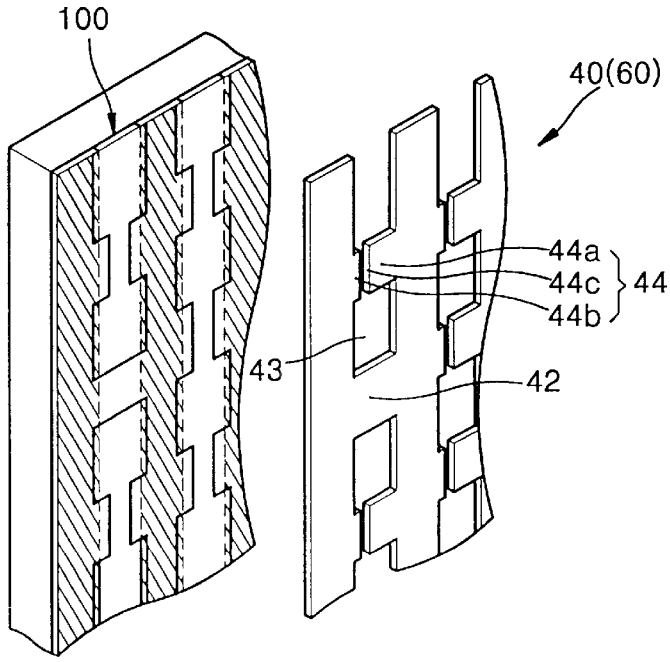

Also, as shown in FIG. 12, since the position of the dummy slot 44*c* is displaced toward the peripheral portion of the tension mask 40 and a degree of displacement is greater at the peripheral portion, directivity of the fluorescent film pattern by clipping of the electron beam and directivity of the exposure pattern during exposure of fluorescent film using the mask while the electron beam passes through the dummy slot 44*c* due to the difference in the incident angle of the electron beam emitted from the electron gun can be improved.

As shown in FIGS. 9 and 10, when the tension mask 60 is divided into the uniform dummy bridge area S1 and the decreasing dummy bridge area portion S2, visibility at the peripheral portion of the tension mask where the amount of the clipping of the electron beam is relatively great can be improved.

In detail, when the electron beam emitted from the electron gun is scanned to the uniform dummy bridge area S1 of the tension mask 60, some of the electron beam passing through the slot 63 is completely shielded by the tie bar 64. However, since the dummy bridge 64 is formed to be large as much as the area of a dummy slot 64*c*, the shades of the real bridge 62 and the dummy bridge 64 appearing on the fluorescent film are the same so that visibility can be improved. When the electron beam emitted from the electron gun is scanned to the decreasing dummy bridge area S2 of the tension mask 60, the incident angle on the dummy slot 64*c* gradually increases toward the peripheral portion so that the amount of light of the electron beam passing through the dummy slot 64*c* is relatively small. Thus, although the shade by the dummy bridge 64 is greater than the shade of the real bridge 62, the area of the dummy bridge 64 gradually decreases so that the shades of the real bridge 62 and the dummy bridge 64 are the same.

The principles of the present invention include, among other things, a decreasing area of dummy bridges, a decreasing vertical length of dummy bridges, and a shifting of dummy bridge slots. An area of a dummy bridge located at an edge region of a tension mask is less than an area of a dummy bridge located at a central region of the tension mask, in accordance with the principles of the present invention.

When a person views dummy bridges in a central region of a tension mask, and then that person views dummy bridges at an intermediate location between the central region and an outermost edge region, and lastly that person views dummy bridges at the outermost edge region, that person can observe a clear trend related to the dummy bridges. The clear trend is as follows: the area of each individual dummy bridge decreases, the vertical length of each individual dummy bridge decreases, and the dummy slot in each individual dummy bridge shifts toward the outermost edge region, in accordance with the principles of the present invention.

The area of individual dummy bridges decreases when a person considers dummy bridges in a central region and then gradually looks out toward the edge regions, the vertical length of individual dummy bridges decreases when a person considers dummy bridges in a central region and then gradually looks out toward the edge regions, and the location of individual dummy slots in dummy bridges shifts when a person considers dummy bridges in a central region and then gradually looks out toward the edge regions, in accordance with the principles of the present invention.

As described above, in the tension mask frame assembly for a color picture tube having the above structure according to the present invention, since the vertical widths of the first and second protruding portions forming the dummy bridge is formed to be narrow from the central portion of the tension mask to the peripheral portion thereof, visibility of the real bridge and the dummy bridge appearing on an image can be improved. Furthermore, uniform brightness can be obtained from the entire screen surface.

While the present invention has been illustrated by the description of embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus and method, and illustrative examples shown and described. Accordingly, departures may be made from such details without departing from the spirit or scope of the applicant's general inventive concept.

What is claimed is:

1. A tension mask frame assembly apparatus for a color picture tube, the apparatus comprising:

a tension mask forming a plurality of strips on a thin plate, a plurality of slots, a plurality of tie bars connecting said strips and sectioning said slots at a predetermined pitch, and a plurality of dummy bridges extending from at least one strip toward an adjacent strip in said slots, said strips being separated a predetermined distance by said slots, said tension mask having a central portion and having a plurality of edges; and a frame supporting said edges and applying tension to said tension mask, an area of each of said dummy bridges near said edges being less than an area of each of said dummy bridges at a central region of said tension mask.

2. The apparatus of claim 1, a vertical length of each of said dummy bridges at said central region of said tension mask being greater than a vertical length of each of said tie bars at said central region.

3. The apparatus of claim 2, a vertical length of each of said dummy bridges near said edges being not less than a vertical length of each of said tie bars near said edges.

4. The apparatus of claim 1, each of said dummy bridges including a first protruding portion and a second protruding portion, said first protruding portion extending from a first strip into a first slot in a first direction, said second protruding portion extending from a second strip into said first slot in a second direction, said first and second directions being opposite to each other, said first and second strips being adjacent to each other, said first and second protruding portions forming a dummy slot between said first and second protruding portions.

5. The apparatus of claim 4, a position of said dummy slot being centrally located between said first and second strips when said first and second strips are located at said central region.

6. The apparatus of claim 4, a position of said dummy slot being not centrally located between said first and second strips when said first and second strips are not located at said central region.

7. The apparatus of claim 1, the areas of said dummy bridges gradually decreasing in a direction from said central region toward said edges.

8. The apparatus of claim 1, said edges of said tension mask including four individual edges, a first two edges of said four edges being opposite to each other and being directly supported by said frame, a second two edges of said four edges being opposite each other and not being directly supported by said frame, the areas of said dummy bridges gradually decreasing in a first direction from said central region toward a first one of said second two edges, the areas of said dummy bridges gradually decreasing in a second direction from said central region toward a second one of said second two edges, said first direction being opposite to said second direction.

9. The apparatus of claim 1, further comprising:

said tension mask being divided into three regions corresponding to said central region, a first outer region, and a second outer region;

said edges of said tension mask including four individual edges, a first pair of edges of said four edges being opposite to each other and being directly supported by said frame, a second pair of edges of said four edges being opposite each other and not being directly supported by said frame;

said first outer region being disposed between a first edge of said second pair of edges and said central region, said second outer region being disposed between a second edge of said second pair of edges and said central region; and said first outer region, second outer region, and central region each extending from a first edge of said first pair of edges to a second edge of said first pair of edges.

10. The apparatus of claim 9, each of said dummy bridges including a first protruding portion and a second protruding portion, said plurality of strips including at least a first and second strip, said plurality of slots including at least a first slot, said first protruding portion extending from said first strip into said first slot in a first direction toward said second strip, said second protruding portion extending from said second strip into said first slot in a second direction toward said first strip, said first and second directions being opposite to each other, said first and second strips being adjacent to each other, said first and second protruding portions forming a dummy slot between said first and second protruding portions.

11. The apparatus of claim 10, a position of said dummy slot being centrally located between said first and second strips when said first and second strips are located at said central region.

12. The apparatus of claim 10, a position of said dummy slot being not centrally located between said first and second strips when said first and second strips are located at a region selected from among said first outer region and said second outer region.

13. The apparatus of claim 10, said first and second strips being located at said first outer region near said first edge of said second pair of edges, said first strip being closer to said first edge of said second pair of edges than said second strip, said second strip being disposed between said first strip and said central region, a position of said dummy slot being not centrally located between said first and second strips, said position of said dummy slot being located closer to said first strip than to said second strip.

14. The apparatus of claim 13, said first and second strips being located at said second outer region near said second edge of said second pair of edges, said first strip being closer to said second edge of said second pair of edges than said second strip, said second strip being disposed between said first strip and said central region, a position of said dummy slot being not centrally located between said first and second strips, said position of said dummy slot being located closer to said first strip than to said second strip.

15. The apparatus of claim 10, said first and second strips being located at said second outer region near said second edge of said second pair of edges, said first strip being closer to said second edge of said second pair of edges than said second strip, said second strip being disposed between said first strip and said central region, a position of said dummy slot being not centrally located between said first and second strips, said position of said dummy slot being located closer to said first strip than to said second strip, a width from a center of said dummy slot to said first strip being equal to W.

16. The apparatus of claim 15, said first and second strips being located at said second outer region near said central region and not near said second edge of said second pair of edges, said first strip being closer to said second edge of said second pair of edges than said second strip, said second strip being disposed between said first strip and said central region, a position of said dummy slot being not centrally located between said first and second strips, said position of said dummy slot being located closer to said first strip than to said second strip, a width measured from a center of said dummy slot to said first strip being greater than W.

17. The apparatus of claim 9, the areas of said dummy bridges near each edge of said second pair of edges being less than the areas of said dummy bridges at said central region.

18. The apparatus of claim 9, the areas of said dummy bridges at said central region near each edge of said first pair of edges being equal to the areas of said dummy bridges at said central region not near each edge of said first pair of edges.

19. The apparatus of claim 18, the areas of said dummy bridges at said first and second outer regions being less than the areas of said dummy bridges at said central region.

20. An apparatus, comprising:

a tension mask including a plurality of strips formed on a thin plate and separated a predetermined distance by slots, a plurality of tie bars connecting said strips and sectioning said slots at a predetermined pitch, and a plurality of dummy bridges extending from at least one of said strips toward an adjacent one of said strips in said slots; and a frame supporting said tension mask and applying tension to said tension mask;

said tension mask including a centrally-located uniform dummy bridge area portion in which the area of each of said dummy bridges is uniform, said tension mask including a decreasing dummy bridge area portion in which an area of each of said dummy bridges gradually decreases in a direction from said uniform dummy bridge area portion to a peripheral portion of said tension mask.

21. The apparatus of claim 20, a length of said tension mask measured in a first horizontal direction being H, a vertical center line of said uniform dummy bridge area portion being located at H/2, a vertical boundary between said uniform dummy bridge area portion and said decreasing dummy bridge area portion being located at a position selected from among a first position that is displaced +H/6 from the vertical center line as measured in said horizontal direction and a second position displaced −H/6 from the vertical center line as measured in said horizontal direction.

22. The apparatus of claim 21, said dummy bridges at said decreasing dummy bridge area portion being located at a plurality of positions including at least an innermost position and an outermost position, said innermost position being located in said decreasing dummy bridge area portion at a location closest to said uniform dummy bridge area portion, said outermost position being located in said decreasing dummy bridge area portion at a location furthest from said uniform dummy bridge area portion, an area of each of said dummy bridges at said outermost position being equal to an area of each of said tie bars.

23. The apparatus of claim 20, a vertical length of each of said dummy bridges at said decreasing dummy bridge area portion gradually decreasing as said dummy bridges are located closer to said peripheral portion of said tension mask.

24. The apparatus of claim 23, said dummy bridges at said decreasing dummy bridge area portion being located at a plurality of positions including at least an innermost position and an outermost position, said innermost position being located in said decreasing dummy bridge area portion at a location closest to said uniform dummy bridge area portion, said outermost position being located in said decreasing dummy bridge area portion at a location furthest from said uniform dummy bridge area portion, an area of each of said dummy bridges at said outermost position being equal to an area of each of said tie bars.

25. The apparatus of claim 20, said dummy bridges at said decreasing dummy bridge area portion being located at a plurality of positions including at least an innermost position and an outermost position, said innermost position being located in said decreasing dummy bridge area portion at a location closest to said uniform dummy bridge area portion, said outermost position being located in said decreasing dummy bridge area portion at a location furthest from said uniform dummy bridge area portion, an area of each of said dummy bridges at said outermost position being equal to an area of each of said tie bars.

26. A tension mask frame assembly apparatus for a color cathode ray tube, the apparatus comprising:

a tension mask having a plurality of strips formed on a thin plate and separated a predetermined distance by slots, a plurality of tie bars connecting said strips and sectioning said slots at a predetermined pitch, and a plurality of dummy bridges extending from at least one of said strips toward an adjacent one of said strips in said slots sectioned by said tie bars; and a frame supporting said tension mask and applying tension to said tension mask, an area of one of said dummy bridges located at a central portion of said tension mask being greater than an area of one of said dummy bridges located at a peripheral portion of said tension mask away from said central portion.

27. The apparatus of claim 26, a vertical length of each of said dummy bridges at said central portion of said tension mask being greater than a vertical length of each of said tie bars.

28. The apparatus of claim 27, a vertical length of each of said dummy bridges at said peripheral portion being not less than a vertical length of each of said tie bars.

29. The apparatus of claim 26, each of said dummy bridges including a first protruding portion and a second protruding portion, said first protruding portion extending from a first strip into a first slot in a first direction, said second protruding portion extending from a second strip into said first slot in a second direction, said first and second directions being opposite to each other, said first and second strips being adjacent to each other, said first and second protruding portions forming a dummy slot between said first and second protruding portions.

30. The apparatus of claim 29, a position of said dummy slot being centrally located between said first and second strips when said first and second strips are located at said central portion.

31. The apparatus of claim 29, a position of said dummy slot being not centrally located between said first and second strips when said first and second strips are not located at said central portion.

32. The apparatus of claim 29, said dummy bridges at said peripheral portion being located at a plurality of positions including at least an innermost position and an outermost position, said innermost position being located in said peripheral portion at a location closest to said central portion, said outermost position being located in said peripheral portion at a location furthest from said central portion, an area of each of said dummy bridges at said outermost position being equal to an area of each of said tie bars.

33. The apparatus of claim 32, said first and second strips being located at said peripheral portion near said outermost position, said first strip being closer to said outermost position than said second strip, said second strip being disposed between said first strip and said central portion, a position of said dummy slot being not centrally located between said first and second strips, said position of said dummy slot being located closer to said first strip than to said second strip.

34. An apparatus, comprising:

a tension mask forming a plurality of strips including at least a first strip and a second strip, a plurality of slots including at least a first slot, a plurality of tie bars connecting said strips and sectioning said slots, and a plurality of dummy bridges extending into at least one of said slots from at least one of said strips toward an adjacent one of said strips, said strips being separated by said slots, said tension mask including a central region and a first outer region, said plurality of dummy bridges including at least a first dummy bridge; and a frame supporting said tension mask and applying tension to said tension mask;

said first and second strips being located near said first outer region and not near said central region, said first strip being disposed between said first outer region and said second strip, said second strip being disposed between said first strip and said central region;

said first dummy bridge including a first protruding portion and a second protruding portion, said first protruding portion extending from said first strip into said first slot in a first direction toward said second strip, said second protruding portion extending from said second strip into said first slot in a second direction toward said first strip, said first and second protruding portions forming a first dummy slot between said first and second protruding portions, said first dummy slot being closer to said first strip than to said second strip.

35. The apparatus of claim 34, further comprising:

said tension mask including a second outer region, said central region being disposed between said first and second outer regions;

said plurality of slots including at least a second slot;

said plurality of strips including at least a third strip and a fourth strip; and said plurality of dummy bridges including at least a second dummy bridge;

said third and fourth strips being located near said second outer region and not near said central region, said third strip being disposed between said fourth strip and said central region, said fourth strip being disposed between said third strip and said second outer region;

said second dummy bridge including a third protruding portion and a fourth protruding portion, said third protruding portion extending from said third strip into said second slot in said first direction toward said fourth strip, said fourth protruding portion extending from said fourth strip into said second slot in said second direction toward said third strip, said third and fourth protruding portions forming a second dummy slot between said third and fourth protruding portions, said second dummy slot being closer to said fourth strip than to said third strip.

36. The apparatus of claim 34, further comprising:

said plurality of slots including at least a second slot;

said plurality of strips including at least a third strip and a fourth strip; and said plurality of dummy bridges including at least a second dummy bridge;

said third and fourth strips being located at said central region, said third strip being disposed between said fourth strip and said first outer region;

said second dummy bridge including a third protruding portion and a fourth protruding portion, said third protruding portion extending from said third strip into said second slot in said first direction toward said fourth strip, said fourth protruding portion extending from said fourth strip into said second slot in said second direction toward said third strip, said third and fourth protruding portions forming a second dummy slot between said third and fourth protruding portions, said second dummy slot being centrally located between said third strip and said fourth strip.

37. An apparatus, comprising:

a tension mask forming a plurality of strips including at least a first strip and a second strip, a plurality of slots including at least a first slot, a plurality of tie bars connecting said strips and sectioning said slots, and a plurality of dummy bridges extending into at least one of said slots from at least one of said strips toward an adjacent one of said strips, said strips being separated by said slots, said tension mask having a central portion and having a plurality of edges including at least a support edge and a first outermost edge, said plurality of dummy bridges including at least a first dummy bridge; and a frame supporting said support edge and applying tension to said tension mask;

said first and second strips being located near said first outermost edge and not near said central portion, said first strip being disposed between said first outermost edge and said second strip, said second strip being disposed between said first strip and said central portion;

said first dummy bridge including a first protruding portion and a second protruding portion, said first protruding portion extending from said first strip into said first slot in a first direction toward said second strip, said second protruding portion extending from said second strip into said first slot in a second direction toward said first strip, said first and second protruding portions forming a first dummy slot between said first and second protruding portions, said first dummy slot being closer to said first strip than to said second strip.

38. The apparatus of claim 37, further comprising:

said plurality of edges including at least a second outermost edge, said central portion being disposed between said first and second outermost edges;

said plurality of slots including at least a second slot;

said plurality of strips including at least a third strip and a fourth strip; and said plurality of dummy bridges including at least a second dummy bridge;

said third and fourth strips being located near said second outermost edge and not near said central portion, said third strip being disposed between said fourth strip and said central portion, said fourth strip being disposed between said third strip and said second outermost edge;

said second dummy bridge including a third protruding portion and a fourth protruding portion, said third protruding portion extending from said third strip into said second slot in said first direction toward said fourth strip, said fourth protruding portion extending from said fourth strip into said second slot in said second direction toward said third strip, said third and fourth protruding portions forming a second dummy slot between said third and fourth protruding portions, said second dummy slot being closer to said fourth strip than to said third strip.

* * * * *